US006904651B2

(12) United States Patent
Pontone et al.

(10) Patent No.: US 6,904,651 B2
(45) Date of Patent: Jun. 14, 2005

(54) BURIAL CASKET WITH CURVED-CORNER THROUGH-FITTING AND METHOD OF MANUFACTURE

(75) Inventors: Michael Pontone, Brooklyn, NY (US); Dale Palmer, Richmond, IN (US)

(73) Assignee: Indiana Casket Products LLC, Richmond, IN (US)

( * ) Notice: Subject to any disclaimer, the term of this patent is extended or adjusted under 35 U.S.C. 154(b) by 77 days.

(21) Appl. No.: 10/626,417

(22) Filed: Jul. 23, 2003

(65) Prior Publication Data

US 2005/0015949 A1 Jan. 27, 2005

(51) Int. Cl.[7] ..... A61G 17/00

(52) U.S. Cl. ..... 27/10; 27/1; 27/DIG. 1; 292/336.3

(58) Field of Search ..... 27/10–DIG. 1; 292/336.3, 337, DIG. 53

(56) References Cited

U.S. PATENT DOCUMENTS

| | | | |
|---|---|---|---|
| 574,250 | A | 12/1896 | Leonard et al. |
| 1,208,550 | A | 12/1916 | Hand |
| 1,467,824 | A | 9/1923 | Ahlers |
| 2,073,875 | A | 3/1937 | Neff |
| 2,323,674 | A | 7/1943 | Purkiss |
| 2,417,756 | A | 3/1947 | Hillenbrand |
| 2,582,841 | A | 1/1952 | McEwan |
| 2,587,355 | A | 2/1952 | McEwan |
| 2,676,479 | A | 4/1954 | Bethune |
| 2,691,543 | A | 10/1954 | Morand |
| 2,753,613 | A | 7/1956 | Baker, Jr. |
| 2,834,628 | A | 5/1958 | Paparelli et al. |
| 2,845,294 | A | 7/1958 | Peterson et al. |
| 3,201,165 | A | 8/1965 | Trudeau |
| 3,474,648 | A | 10/1969 | Trinca |
| 3,623,758 | A | 11/1971 | Trinca |
| 4,012,883 | A | 3/1977 | Muller |
| 4,697,316 | A | 10/1987 | Semon |
| 4,706,437 | A | 11/1987 | Boecker, Jr. |
| 5,060,993 | A | 10/1991 | Maier |
| 5,265,923 | A | 11/1993 | Paddock |
| 5,457,861 | A | 10/1995 | Lloyd |
| 5,503,439 | A | 4/1996 | LaJeunesse et al. |
| 5,555,612 | A | 9/1996 | Biondo |
| 5,611,124 | A | 3/1997 | Biondo et al. |
| 5,675,876 | A | 10/1997 | Benedict et al. |
| 5,727,291 | A | 3/1998 | Biondo et al. |
| 5,729,921 | A | 3/1998 | Rojas |
| 5,771,550 | A | 6/1998 | Laphan et al. |
| 5,875,529 | A | 3/1999 | Ollier |
| 5,974,640 | A | 11/1999 | Vosahlik et al. |
| 6,116,663 | A | 9/2000 | Robert |
| 6,152,499 | A | 11/2000 | Robert |
| 6,238,327 | B1 | 5/2001 | Tambussi |
| 6,279,212 | B1 | 8/2001 | Balch |
| 6,324,737 | B1 | 12/2001 | Chamness et al. |
| 6,385,824 | B1 | 5/2002 | Schwartz |
| 6,414,663 | B1 | 7/2002 | Manross, Jr. |
| 6,463,703 | B1 | 10/2002 | Mattis |
| 6,574,841 | B1 | 6/2003 | Vosahlik et al. |

*Primary Examiner*—William L. Miller
(74) *Attorney, Agent, or Firm*—Schweitzer Cornman Gross & Bondell LLP

(57) ABSTRACT

A burial casket with a through-fitting on a curved corner of the casket has a hole in the curved corner of the casket with a rim that has a convex outer surface and a concave inner surface. The through-fitting disposed within the hole has a body portion with a through hole along an axis and a concave, shape-conforming shoulder portion. The shoulder portion is in contact with and conforms to the convex outer surface of the rim of the hole. A neck portion of the through-fitting extends axially from the shoulder portion and through the hole. The neck portion has a radially-outwardly extending integral flange portion that conforms to and is in contact with the concave inner surface of said hole substantially around an entire periphery of the hole. The body portion is integral and in one piece or is an assembly of inner and outer tubes. The integral flange is formed by directing a shape-conforming crimping tool against a concave, shape-conforming end face of the neck portion of the through-fitting.

16 Claims, 4 Drawing Sheets

BURIAL CASKET WITH CURVED-CORNER THROUGH-FITTING AND METHOD OF MANUFACTURE

FIELD OF THE INVENTION

The invention pertains to the field of through-fittings for burial caskets, and in particular to through-fittings for curved corner portions of burial caskets.

BACKGROUND AND SUMMARY OF THE INVENTION

Metal burial caskets often include a shell formed from relatively thin metal, stamped and formed into a desired shape. A relatively thin exterior metal wall of the casket which may be painted or covered in some manner.

Through-fittings for burial caskets are desired for a number of reasons including providing access through the exterior wall to a casket latch/lock mechanism, and for providing access to a portion of the interior of the burial casket for the storage of mementos and other memorabilia without the need to open the casket lid.

Through-fittings that provide access to casket latch/lock mechanisms are commonly referred to as lock end tubes. Lock end tubes are typically disposed on an end wall of the casket and provide a cylindrical orifice through the casket end wall to access and articulate the casket lock mechanism. The casket lock mechanism often includes a shaft that extends into the lock end tube. The lock mechanism is actuated by inserting a tool into an appropriately-shaped recess in an end portion of the shaft and rotating the shaft. The lock end tube often may be closed and sealed by a threaded cap.

Through-fittings for providing storage space for mementos and other memorabilia commonly form an aperture in the casket end wall for receiving a capsule holding memorabilia of the deceased. The aperture is typically covered with a cap or other closure device and may be accessed without opening the lid of the casket.

Caskets may be provided with curved, or arcuate corner portions, which provide an aesthetically pleasing appearance to the casket. The exterior surface of the casket wall in the curved corner is substantially convex in shape, whereas the interior surface of the casket wall in the curved corner is substantially concave.

Often, a desirable location for through-fittings for access to lock mechanisms or memorial capsules is the corner portion of the casket. However, for caskets with curved corners, the curved surfaces of the corner present some difficulties in mounting the through-fitting structures.

To overcome difficulties in mounting a through-fitting to the curved portion of the casket, a prior through-fitting for a lock end tube for a curved corner of a casket has inner and outer tubes and a pair of complimentary-shaped parts. One shaped part conforms to the convex exterior surface of the casket wall and the other conforms to the concave interior surface. The complimentary-shaped parts are disposed on opposite sides of the exterior wall of the casket and are clamped together by a screw thread to affix the through-fitting to the casket wall. This through-fitting structure provides certain benefits over previous structures, however, this prior structure requires an undesirable number of parts and manufacturing steps.

A prior through-fitting for a memorial tube has an integral mounting tube affixed to a flat (i.e., planar) portion of the casket corner by a crimping step. A capsule or similar container may be threaded into the mounting tube and sealed. This through-fitting structure provides certain benefits over previous structures however the structure is not suitable for mounting on an arcuate surface (i.e., a curved corner).

The present invention overcomes the drawbacks of the prior art and provides a through-fitting for curved corners of burial caskets suitable for a variety of uses including providing access to casket lock mechanisms and for providing storage within the casket for mementos and memorabilia of the deceased.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE PREFERRED EMBODIMENTS

Figure 1:
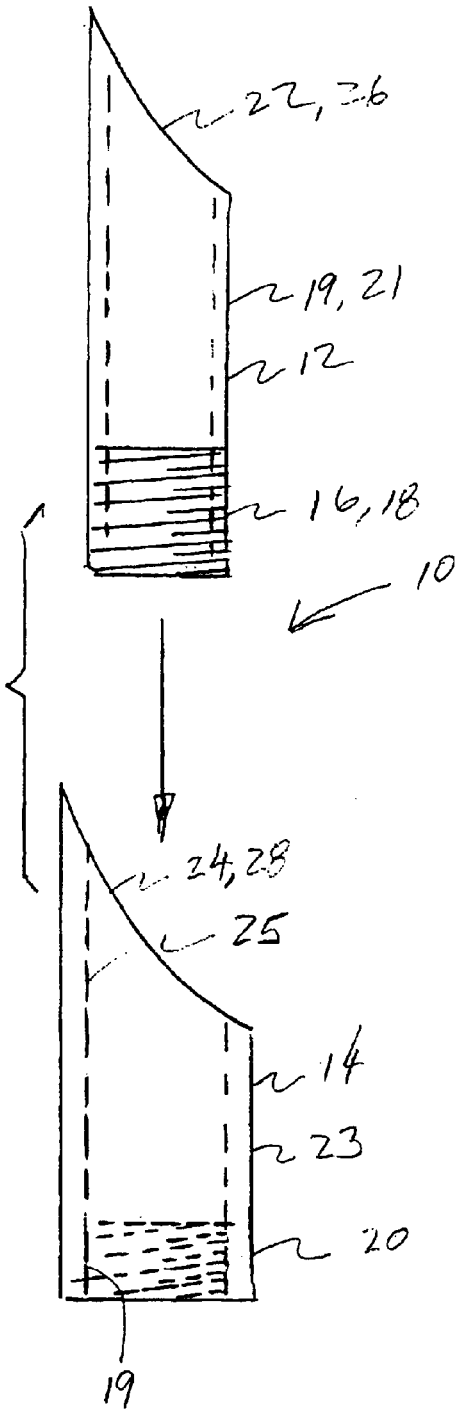
FIG. 1 is an exploded, top view of a first embodiment of a through-fitting made in accordance with the invention, showing the inner and outer tubes.
Figure 2:
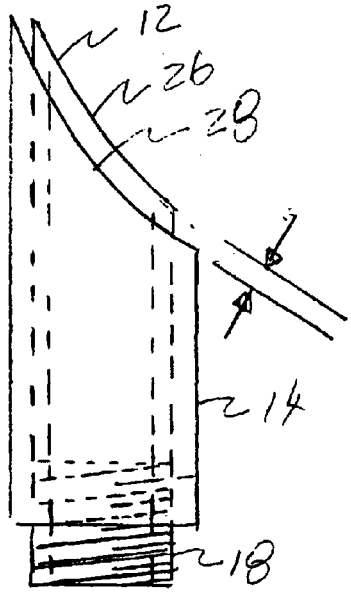
FIG. 2 is a top view of the through-fitting of FIG. 1, showing the inner and outer tubes in an assemble configuration.

Referring to FIGS. 1 and 2, a first embodiment of a through-fitting 10 constructed according to the present invention includes inner and outer metal tubes 12, 14 sized and shaped such that the inner tube 12 fits snugly coaxially within the outer tube 14. A first end 16 of the inner tube 12 has external threads 18 and a first end 20 of the outer tube 14 has internal threads 19 that mesh with those of the inner tube 12.

Preferably, a body portion 19 of the inner tube 12 has an outer diameter 21 substantially equal to an outer diameter of the threads 18 of the inner tube 12 and a body portion 23 of the outer tube 14 has an internal diameter 25 sized to closely receive the body portion of the inner tube 12.

Second end portions 22, 24 of each of the inner and outer tubes 12, 14 have substantially concave, annular end faces 26, 28. The second end portion 24 of the outer tube 14 which conforms to a curved corner portion 36 of a casket 30.

As a first step in assembling the through-fitting 10, the first (i.e., threaded) end 16 of the inner tube 12 is inserted through the end face 28 of the outer tube 14 and threaded into the outer tube 14 such that the concave end faces 26, 28 thereof are spaced a predetermined distance apart (as shown in FIG. 2). In this position, centers of curvature of the end faces 26, 28 are located at substantially the same point. Further, the end face 26 of the inner tube 12 is disposed axially outwardly from the end face 28 of the outer tube 14 a predetermined distance of preferably about $1/10^{th}$ of an inch, or most preferably about 0.094 inches.

Preferably, the threads of the inner and/or outer tubes 12, 14 are disposed such that when the inner tube 12 is fully threaded into the outer tube 14, the end faces 26, 28 are in the above-described proper alignment and are spaced the proper predetermined distance from one another. The inner and outer tubes 12, 14 may be secured in the proper relative position by thread locking compound or by some other mechanical or adhesive means at this point in the assembly process.

Figure 2A:
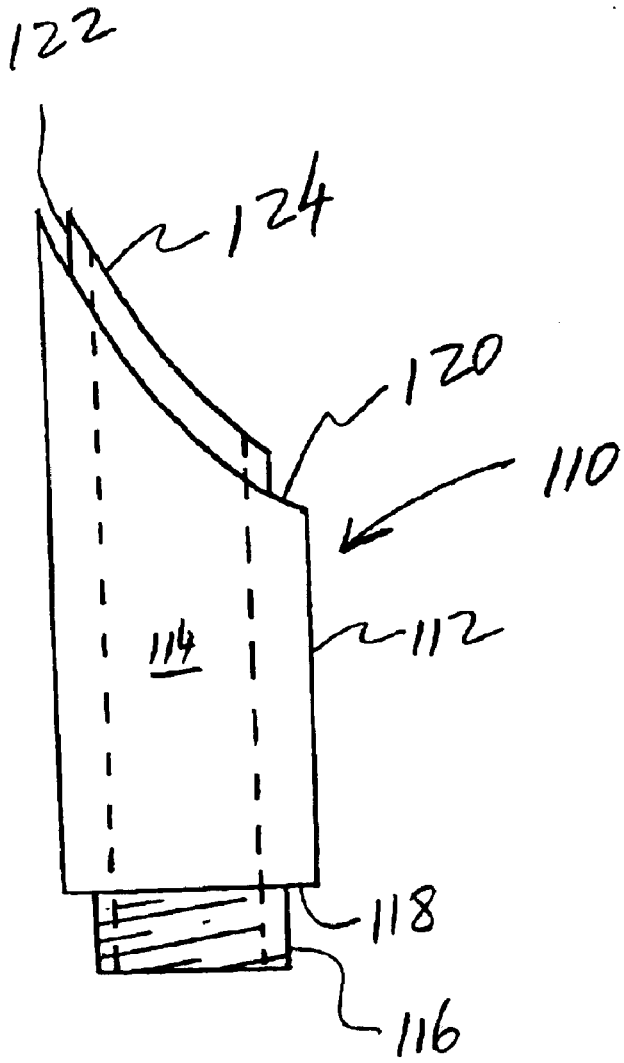
FIG. 2A is a top view of a second embodiment of a through-fitting, showing the inner and outer tubes in an assemble configuration.

Referring to FIG. 2A, a second embodiment of the through-fitting 110 is formed as an integral, metal piece. The integral through-fitting 110 has a preferably cylindrical main body portion 112 having a through hole 114. A threaded, cap-receiving end 116 extends from a first end 118 of the body portion 112 for receiving a threaded cap. The body portion 112 has a shape-conforming, annular shoulder portion 120, which is similar in shape and location to the second end face 28 of the outer tube 14 described with respect to the first embodiment above. A neck portion 122 having an outside diameter less than that of the body portion 112 extends axially outwardly from the body portion 112. The neck portion 122 is similar to the protruding portion of the inner tube 12 described above. A shape-conforming, annular end face 124, similar to the end face 26, is disposed at the end of the neck portion 122.

As described with respect to the first embodiment, the shape-conforming, annular shoulder portion 120 and the shape-conforming, annular end face 124 are concave in shape to conform to the curved corner portion 36 of the casket 30. Further, centers of curvature of the shape-conforming, annular shoulder portion 120 and the shape-conforming, annular end face 124 are located at substantially the same point.

Figure 3:
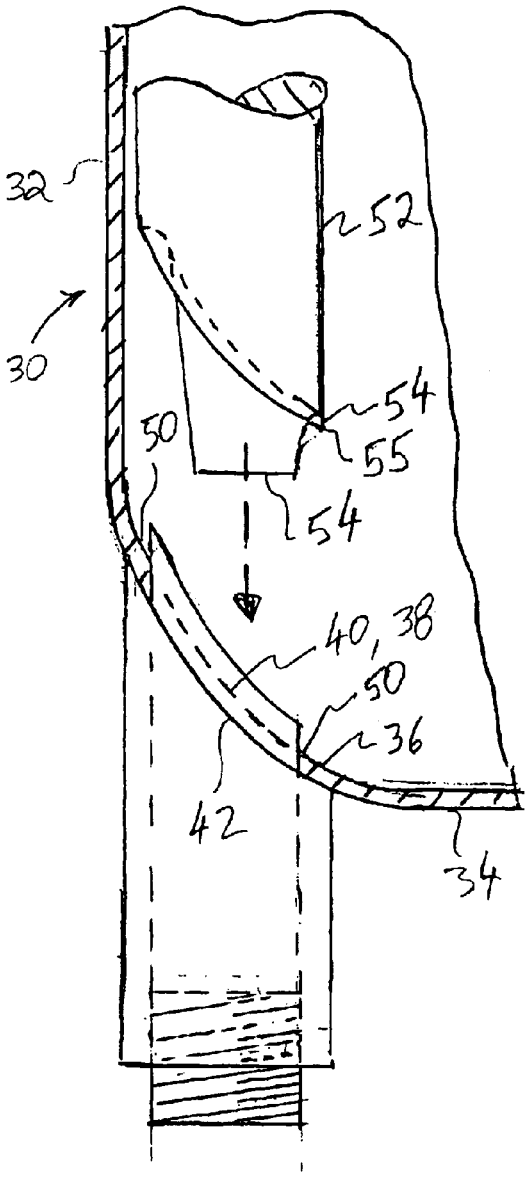
FIG. 3 is a top, cross-sectional view of the through-fitting of FIG. 1 prior to a crimping step.
Figure 4:
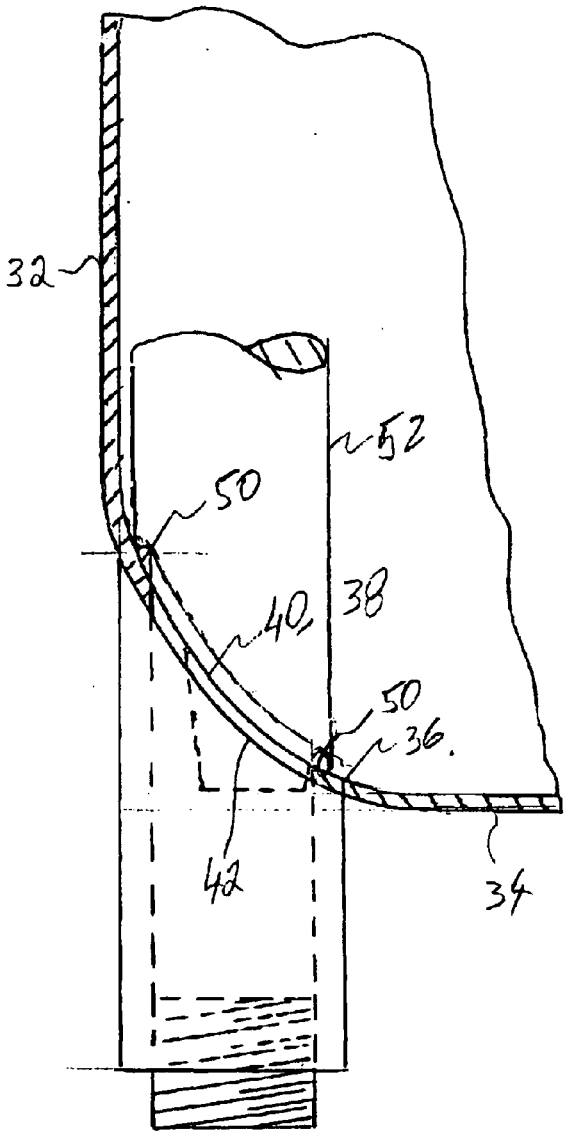
FIG. 4 is a top, cross-section view of the through-fitting of FIG. 1 during the crimping step.
Figure 5:
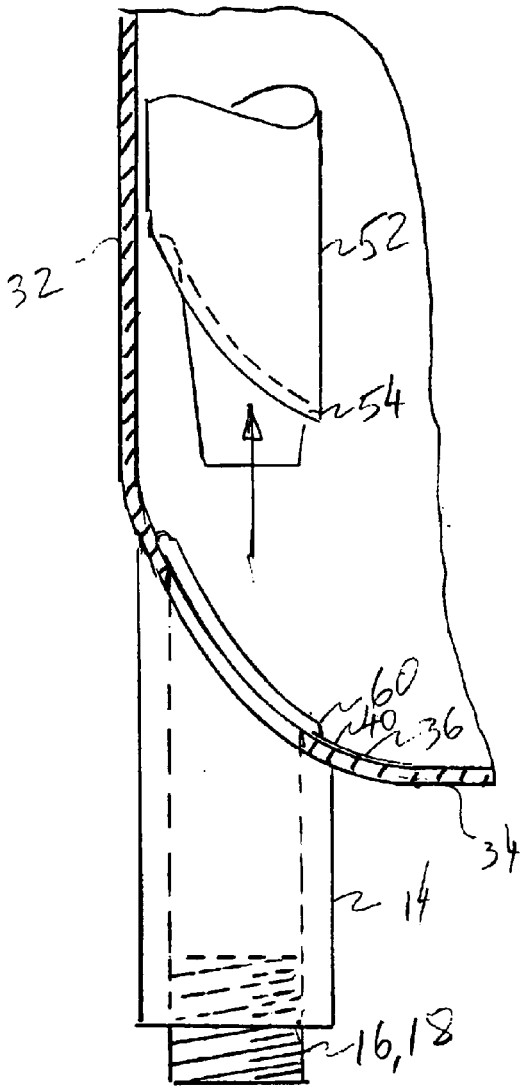
FIG. 5 is a top, cross-section view of the through-fitting of FIG. 1 after the crimping step.

Referring to FIGS. 3–5, the process for mounting a through-fitting constructed according to the present invention is described hereinafter with respect to the two-piece, first embodiment described above. However, it can be appreciated that the method and result is similar for a through-fitting formed as an integral piece.

The metal burial casket 30 is substantially rectangular in shape and has a relatively thin metal outer wall 33. The curved corner portion 36 of the casket 30 joins a substantially straight side wall 32 to a substantially straight end wall 34. An interior surface 40 of the curved corner portion 36 has a substantially concave shape, whereas an exterior surface 42 of the curved corner portion 36 has a substantially convex shape. A hole 38 is formed in the curved corner portion 36 for mounting the through-fitting 10.

Preferably, the hole 38 in the curved corner portion 36 of the casket 30 is sized and shaped such that the through-fitting 10 may be mounted substantially parallel to the side wall 32 of the casket 30. That is, when mounted, a longitudinal axis of the through-fitting 10 is preferably substantially parallel to the side wall 32. As can be appreciated, to mount the (substantially cylindrical) through-fitting 10 in such an orientation, the hole 38 must have a substantially elliptical shape.

To mount the through-fitting 10 to the casket 30, the second end portion 22 of the inner tube 12 is inserted through the hole 38 from the exterior of the casket 30 until the end face 28 of the outer tube 14 abuts the exterior surface 42 of the casket wall 33. The end face 28 of the outer tube 14 is concave in shape to conform to the convex shape of the exterior surface 42 of the curved corner portion 36 of the casket 30, and in particular to conform to a rim 50 defining the hole 38. Preferably substantially the entire end face 28 abuts the rim 50 such that substantially the entire periphery of the second end portion 24 of the outer tube 14 is in contact with the casket wall 32, forming a seal. When fully inserted, the inner tube 12 projects inwardly from the interior surface 40 of the outer wall 33 of the casket 30 a predetermined distance.

To affix the tube assembly to the casket 30, a shape-conforming crimping tool 52 is directed toward the end face 26 of the inner tube 12 from within the interior of the casket 30 in a direction substantially parallel to the longitudinal axis of the inner tube 12. The crimping tool 52 includes an end portion 54 having a radius less than an inside diameter of the inner tube 12 and has a flange-forming portion 54 disposed around a periphery of the crimping tool 52. The flange-forming portion 54 has a substantially U-shaped cross-section and has an outer rim 55 spaced radially outwardly from the outside diameter of the inner tube 12 prior to crimping. The flange-forming portion 54 is shaped to conform to the concave interior surface 40 of the casket wall 33.

When the crimping tool 52 is directed toward the inner tube 12, the end portion 54 of the tool 52 is received within the inner tube 12 and the flange-forming portion 54 contacts the end face 26 of the inner tube 12. Upon the application of a sufficient amount of force, the flange-forming portion 54 of the crimping tool 52 deforms the second end portion 22 of the inner tube 12 radially outwardly and against the interior surface 40 of the casket wall 33, and in particular against the rim 50 surrounding the hole 38. As can be appreciated, during the crimping process, the assembly of the inner and outer tubes 12, 14 is held in place by a balancing force applied outside the casket 30. After the crimping step is complete, the tool 52 is withdrawn.

The concave shape of the end face 22 of the inner tube 12 and the conforming shape of the flange-forming portion 54 of the crimping tool 52 produce a shape-conforming flange 60 around the periphery of inner tube 12, which shape-conforming flange 60 is in contact with the interior surface 40 of the curved corner portion 36 of the casket wall 33 around substantially the entire periphery of the inner tube 12. This contiguous, shape-conforming flange 60 permanently affixes the through-fitting 10 to the casket 30 in a robust and secure manner.

Once the through-fitting 10 is assembled and attached to the casket 30, a shaft of a locking mechanism (not shown) can be directed through the through-fitting 10, in a known manner. A decorative cap (not shown) can be threaded over the outward end of the through-fitting 10.

Figure 6:
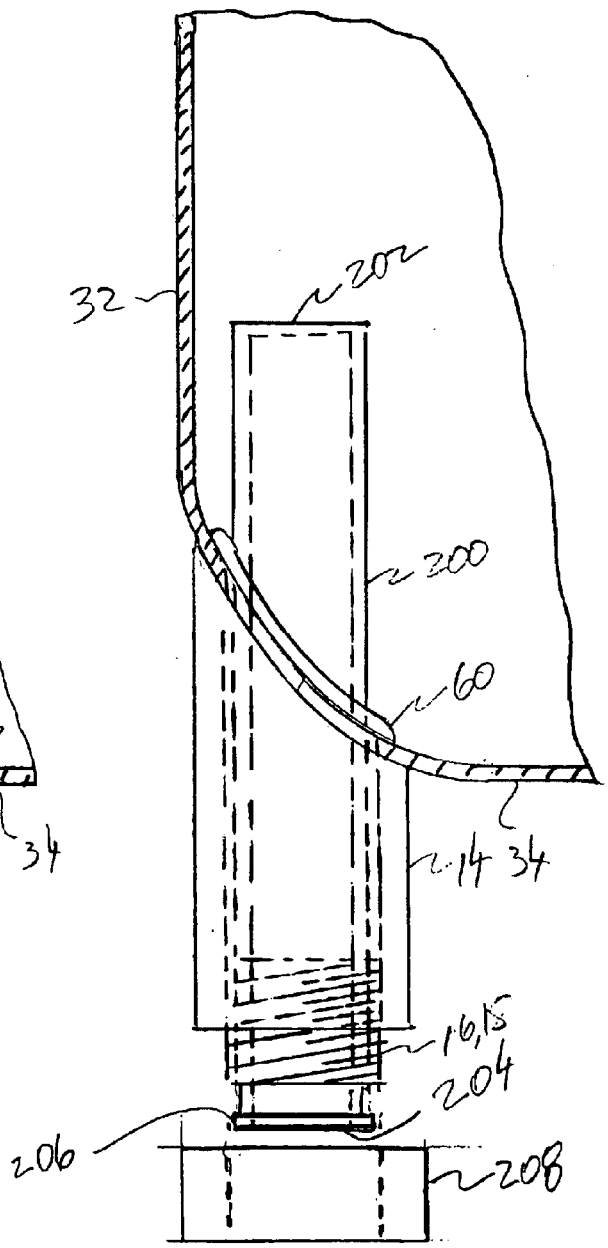
FIG. 6 is a top, cross-section view a memorial capsule inserted within the through-fitting of FIG. 5.

Referring to FIG. 6, the through-fitting 10, once assembled and mounted, can also be used to contain a memorial capsule 200. The capsule 200 is preferably in the form of a plastic, cylindrical tube with a closed end 202, an open end 204 and an integral, annular flange 206 extending radially outwardly from the open end 204. The flange 206 has an outer diameter greater than the inner diameter of the inner tube 12, such that when the closed end 202 of the capsule 200 is inserted into the through-fitting 10, the flange 206 provides a stop.

Once the capsule 200 is inserted into the through-fitting 10, a threaded cap 208 can be threaded over the end 16 of the inner tube 12. As can be appreciated, the threaded cap covers both the capsule 200 and the through-fitting 10. Preferably, the flange 206 has a diameter sized substantially equal to, or slightly less than an inside diameter of threads in the threaded cap 208 such that when the threaded cap 208 is removed, the threads of the cap 208 catch the flange 206 thereby conveniently withdrawing the capsule 200 from the through-fitting 10.

The present invention provides a multi-purpose, secure through-fitting for arcuate corner portions of burial caskets. The through-fitting can be readily assembled and mounted with a single crimping step. It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed:

1. A method of manufacturing a burial casket with a through-fitting on a curved corner of the casket, the method comprising:

providing a through-fitting having a body portion with a through hole along an axis and with a concave, shape-conforming shoulder portion, a neck portion extending axially outwardly from said shoulder portion, said neck portion having an outside diameter less than an outside diameter of said body portion, and a concave, shape-conforming end face disposed on an end of said neck portion;

providing a hole in the curved corner of the casket, said hole having a rim with a convex outer surface and a concave inner surface, said hole being sized and shaped to permit the passage of said neck portion therethrough, and said rim being disposed to engage said shoulder portion;

inserting said neck portion of said through-fitting through said hole from an exterior of the casket; and crimping said neck portion against said rim on said concave inner surface to affix said through-fitting to said burial casket.

2. A method of manufacturing a burial casket with a through-fitting on a curved corner of the casket, as in claim 1, wherein said crimping step further comprises directing a shape-conforming crimping tool against said end face of said neck portion.

3. A method of manufacturing a burial casket with a through-fitting on a curved corner of the casket, as in claim 2, wherein:

said crimping tool comprises and end portion having a radius less than a diameter of said through hole, and having a shape-conforming, flange-forming portion disposed around a periphery of said crimping tool; and said crimping step comprises forming a shape-conforming flange from said neck portion, said flange being in contact with said rim on said concave inner surface.

4. A method of manufacturing a burial casket with a through-fitting on a curved corner of the casket, as in claim 3, wherein:

said flange-forming portion has a substantially U-shaped cross-section with an outer rim spaced radially outwardly from said outside diameter of said neck portion, prior to crimping.

5. A method of manufacturing a burial casket with a through-fitting on a curved corner of the casket, as in claim 3, wherein:

said shape-conforming flange is in contact with said rim on said concave inner surface substantially around an entire periphery of said rim.

6. A method of manufacturing a burial casket with a through-fitting on a curved corner of the casket, as in claim 5, wherein said body portion and said neck portion of said through-fitting are integral and in one-piece.

7. A method of manufacturing a burial casket with a through-fitting on a curved corner of the casket, as in claim 5, further comprising:

said through-fitting is assembled from inner and outer tubes with first and second ends, wherein said inner tube defines said neck portion and said outer tube defines said body portion, said first end of said inner tube having external threads and said first end of said outer tube having internal threads, second ends of said inner and outer tubes each having a substantially concave face, threading said inner tube within said outer tube with said concave face of said inner tube spaced axially outwardly from said concave face of said outer tube, said hole being sized to receive said inner tube and said rim of said hole being disposed to abut said second end of said outer tube, inserting said second end of said inner tube through said hole from an exterior of the casket, with said concave face of said outer tube abutting said exterior of the casket.

8. A method of manufacturing a burial casket with a through-fitting on a curved corner of the casket, the method comprising:

providing inner and outer tubes having first and second ends, said first end of said inner tube having external threads and said first end of said outer tube having internal threads second ends of said inner and outer tubes each having a substantially concave face, threading said inner tube within said outer tube with said concave face of said inner tube spaced axially outwardly from said concave face of said outer tube, forming a hole in a curved corner of the casket, said hole being sized to receive said inner tube and a rim of said hole being disposed to abut said second end of said outer tube, inserting said second end of said inner tube through said hole from an exterior of the casket, with said concave face of said outer tube abutting said exterior of the casket, crimping a portion of said second end of said inner tube against an interior surface of the casket to affix the assembly of said inner and outer tubes to said casket.

9. A method of manufacturing a burial casket with a through-fitting on a curved corner of the casket, as in claim 8, wherein said crimping step comprises directing a shape-conforming crimping tool against said concave face of said second end of said inner tube.

10. A method of manufacturing a burial casket with a through-fitting on a curved corner of the casket, as in claim 9, wherein:

said crimping tool comprises and end portion having a radius less than an inside diameter of said inner tube, and having a shape-conforming, flange-forming portion disposed around a periphery of said crimping tool; and said crimping step comprises forming a shape-conforming flange from said second end of said inner tube, said flange being in contact with said rim on said concave inner surface.

11. A method of manufacturing a burial casket with a through-fitting on a curved corner of the casket, as in claim 10, wherein:

said flange-forming portion has a substantially U-shaped cross-section with an outer rim spaced radially outwardly from an outside diameter of said inner tube, prior to crimping.

12. A burial casket with a through-fitting on a curved corner of the casket, comprising:

a hole in the curved corner of the casket, said hole having a rim with a convex outer surface and a concave inner surface, a through-fitting disposed within said hole, said through-fitting having a body portion with a through hole along an axis and with a concave, shape-conforming shoulder portion, said shoulder portion being in contact with and conforming to said convex outer surface of said rim of said hole, a neck portion extending axially from said shoulder portion and through said hole, said neck portion having an radially-outwardly extending integral flange portion, said integral flange portion being crimped to and conforming to said concave inner surface of said hole.

13. A burial casket with a through-fitting on a curved corner of the casket, as in claim 12, wherein said integral flange portion conforms to and is in contact with said concave inner surface of said hole substantially around an entire periphery of said neck portion.

14. A burial casket with a through-fitting on a curved corner of the casket, as in claim 13, wherein said shoulder portion conforms to and is in contact with said convex outer surface of said rim of said hole substantially around an entire periphery of said body portion of said through-fitting.

15. A burial casket with a through-fitting on a curved corner of the casket, as in claim 14, wherein said body portion and said neck portion of said through-fitting are integral and in one piece.

16. A burial casket with a through-fitting on a curved corner of the casket, as in claim 14, wherein:

said through-fitting is an assembly of inner and outer tubes having first and second ends, wherein said inner tube defines said neck portion and said outer tube defines said body portion, said first end of said inner tube having external threads and said first end of said outer tube having internal threads, second ends of said inner and outer tubes each having a substantially concave face, said inner tube is threaded within said outer tube with said second end of said inner tube extending axially from said concave face of said outer tube.

* * * * *